United States Patent [19]

Beardell

[11] Patent Number: 5,018,764

[45] Date of Patent: May 28, 1991

[54] FOLDABLE BOOK AND BUILDING STRUCTURE

[76] Inventor: Paula Beardell, 56 S. 11 St., Brooklyn, N.Y. 11211

[21] Appl. No.: 472,871

[22] Filed: Jan. 31, 1990

[51] Int. Cl.[5] ..... B42D 1/00; B42D 15/00

[52] U.S. Cl. ..... 281/2; 281/5; 281/15.1; 281/51; 263/34; 263/35; 263/61; 263/62

[58] Field of Search ..... 281/2, 5, 13, 51, 15.1; 283/34, 35, 62, 61

[56] References Cited

U.S. PATENT DOCUMENTS

| | | | |
|---|---|---|---|
| 4,309,835 | 1/1982 | Naeve | 40/124.1 |
| 4,462,178 | 7/1984 | Freeman | 40/124.1 |
| 4,502,711 | 6/1985 | Muth | 283/34 |
| 4,627,640 | 12/1986 | Markovits | 281/51 |
| 4,819,963 | 4/1989 | Wolski | 281/15.1 |
| 4,826,212 | 5/1989 | Muth et al. | 283/34 |
| 4,828,289 | 5/1989 | Korner | 281/15.1 |
| 4,856,818 | 8/1989 | Rabenecker et al. | 283/34 |

FOREIGN PATENT DOCUMENTS

| | | | |
|---|---|---|---|
| 1379655 | 1/1975 | United Kingdom | 283/34 |

*Primary Examiner*—Paul A. Bell

*Attorney, Agent, or Firm*—McAulay Fisher Nissen Goldberg & Kiel

[57] ABSTRACT

A foldable structure for forming imaginative two and three dimensional structures, and for forming a book which has the novel capacity to open from four different directions, each direction revealing a different sequence of pages. The foldable structure is made of a flat planar element which is formed by a plurality of square leaves, flexibly hinged together, creating, when fully unfolded, a pattern resembling a square waveform that has three square leaves per side.

3 Claims, 3 Drawing Sheets

FOLDABLE BOOK AND BUILDING STRUCTURE

BACKGROUND OF THE INVENTION

1. Field of Invention

The present invention pertains, generally, to foldable structures. More particularly the present invention pertains to a foldable structure which has the capacity to be both a book and a foldable building structure.

2. Description of Prior Art

Foldable structures with building potential and books which can function both as a book and a foldable building structure are known in prior art. For example, U.S. Pat. No. 3,962,816 to Sarid (1976) teaches a foldable structure which has the potential to be formed into a myriad of possible foldable configurations; however, this invention does not have the potential to form a book. U.S. Pat. No. 2,471,962 to Klein (1969) teaches a book which is constructed and arranged to function as a game which has building parts and which exists in book form; however, this invention requires many unattached pieces which can be lost and which can too easily fit into a child's mouth. The invention described in U.S. Pat. No. 3,629,967 to Bass (1971) is a foldable building structure which resembles a book when closed; however, this invention functions as a foldable building structure capable of limited variations and it does not at all function as a book.

SUMMARY OF THE PRESENT INVENTION

According to the present invention there is now a product of manufacture which is both a novel kind of book, and a foldable building structure. The invention is formed by a single sheet of successive leaves which, when unfolded, reveals a pattern resembling a square waveform. In its folded form this invention resembles a book and functions as a novel kind of book. The book is novel in that the book has the capacity to be opened from four different directions, each direction revealing a different sequence of pages. Unfolded, the foldable structure can readily be manipulated into hundreds of two and three dimensional configurations.

Thus, in accordance with one embodiment of the present invention, a foldable structure is provided which resembles a square waveform, made of rows of square leaves, three leaves per row, with each square leaf separated from the next square leaf by a folding line. Thus, a first leaf, a second leaf, and a third leaf form a row; a fourth leaf extends from the third leaf so that a right angle is formed by the edges of the second leaf and the fourth leaf; a fifth leaf forms a row extending from the fourth leaf such that the entire configuration is a wide "L" shape; a sixth leaf and seventh leaf extend in a row from the fifth leaf so that a right angle is formed by the edges of the sixth leaf and the fourth leaf, and so that the entire configuration is a "U" shape; an eighth leaf and a ninth leaf extend in a row from the seventh leaf so that a right angle is formed by the edges of the eighth leaf and the sixth leaf. This arrangement of the leaves is repeated any number or part of any number of times, considering the ninth leaf as corresponding to said first leaf of the arrangement.

Said novel book structure is formed from this invention when the leaves of this invention are alternately folded forward and back on the folding lines, accordion style, until the width and height of the invention are equal to the width and height of one square leaf of this invention.

BRIEF DESCRIPTION OF THE DRAWINGS

The invention will be best understood from the description when read in conjunction with the following drawings.

FIG. 4 illustrates the book opening from the right to the left;

FIG. 5 illustrates the book opening from the left to the right;

FIG. 6 illustrates the book opening from the bottom to the top; and

FIG. 7 illustrates the book opening from the top to the bottom.

DETAILED DESCRIPTION OF THE PREFERRED EMBODIMENT

Figure 1:
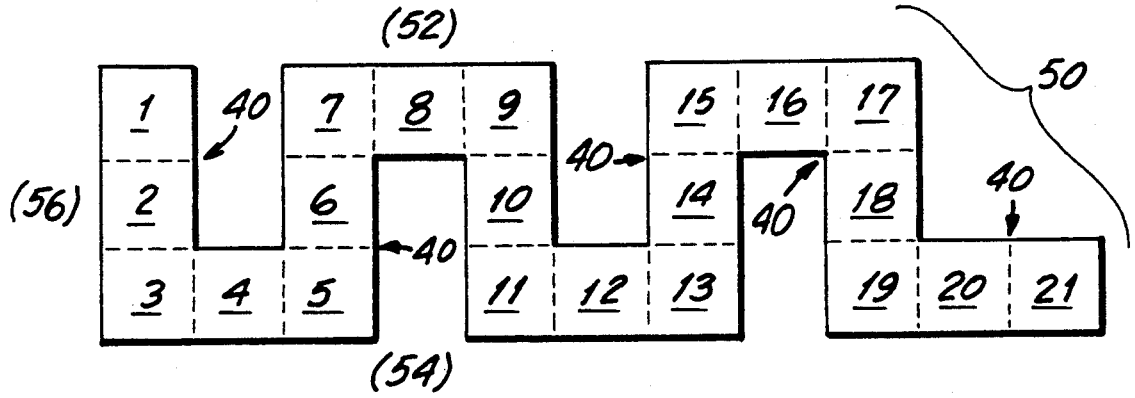
FIG. 1 shows a schematic twenty-one leaf top plan view of the obverse side of a foldable structure, constructed in accordance with the present invention, in a fully opened position.
Figure 2:
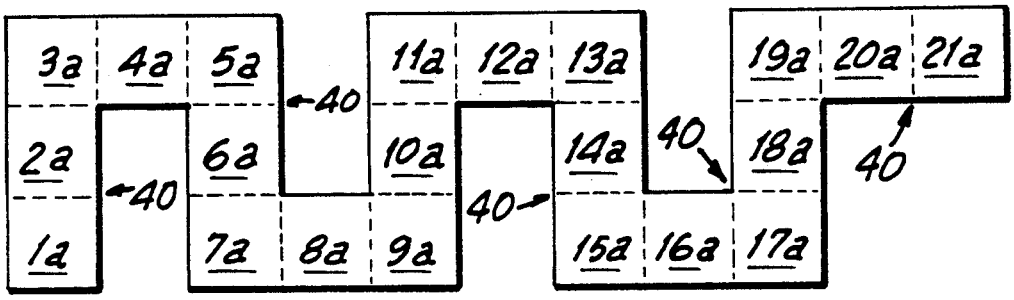
FIG. 2 shows a schematic view of the back side of the invention illustrated in FIG. 1.

Referring to FIG. 1, a foldable structure is constructed in accordance with the present invention is illustrated. Foldable structure 50 is made of a flat planar element having the general outlines illustrated in the solid lines in FIG. 1. Adjacent leaves are separated by folding line 40, allowing the leaves to be folded both forward and back. The leaves of the obverse side of foldable structure 50 are labeled 1–21. FIG. 2 illustrates the back side of each leaf of foldable structure 50. The back side of the leaves are labeled 1–21*a* to correspond to 1–21 on the obverse side of the leaves.

Leaves 1, 2, and 3 are arranged in a row with reference to top 52 and bottom 54, with 1 being at the top of the row, 3 being at the bottom of the row, and 2 being between 1 and 3. Leaf 4, with reference to left 56 and right 58, is positioned to the right 3. 5 is positioned to the right of 4. 6 is positioned next to the top edge 5. 7 is positioned next to the top edge of 6. 8 is positioned to the right of 7. 9 is positioned to the right of 8. The pattern established by the relative positions of 1–9 is repeated, with the position of 9 corresponding to the position of 1, until there are twenty-one leaves in the pattern.

Figure 3:
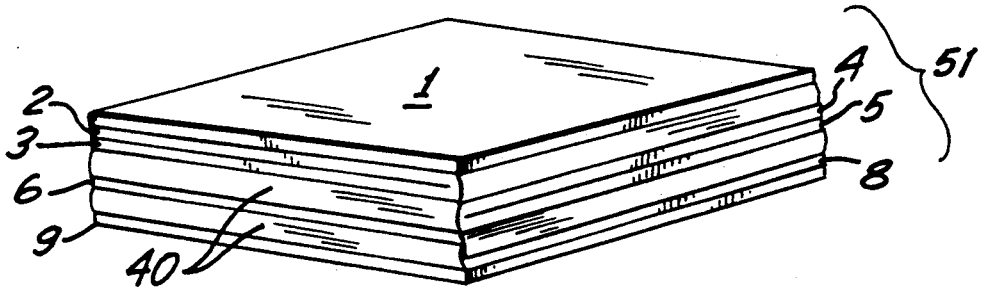
FIG. 3 shows a schematic view of nine leaves of the invention illustrated in FIG. 1 folded into a book form.

FIG. 3 illustrates the first nine leaves of the foldable structure 50, folded in such a way that the structure functions as a novel book structure 51. The folded structure is a novel kind of book in that it opens from four different directions, each direction revealing four different sequences of pages. Thus,

1 folds forward over 2 so that 1 is exposed and 1*a* and 2*a* are flat against each other.

2 folds back over 3 so that 2 and 3 are flat against each other.

3 folds forward over 4 so that 3*a* and 4*a* are flat against each other.

4 folds back over 5 so that 4 and 5 are flat against each other.

5 folds forward over 6 so that 5*a* and 6*a* are flat against each other.

6 folds back over 7 so that 6 and 7 are flat against each other.

7 folds forward over 8 so that 7*a* and 8*a* are flat against each other.

8 folds back over 9 so that 8 and 9 are flat against each other.

To fold the preferred embodiment of this invention into said novel book structure, the above basic sequence of folds is repeated using all twenty-one leaves.

Figure 4:
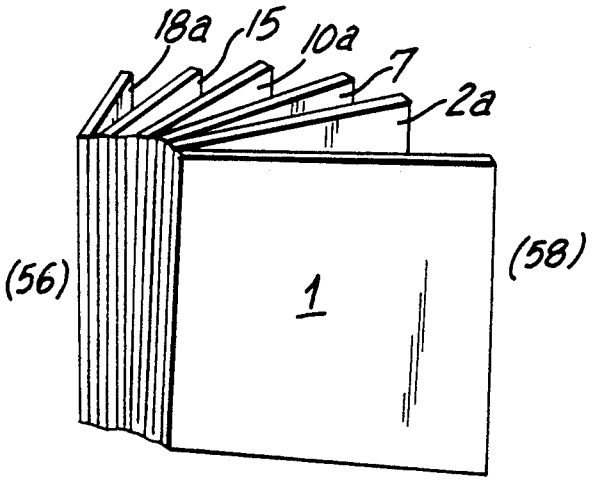
FIGS. 4, 5, 6, and 7 show schematic perspective views of the invention illustrated in FIG. 1, in book form. With references to a left, a right, a top, and a bottom of the book.
Figure 5:
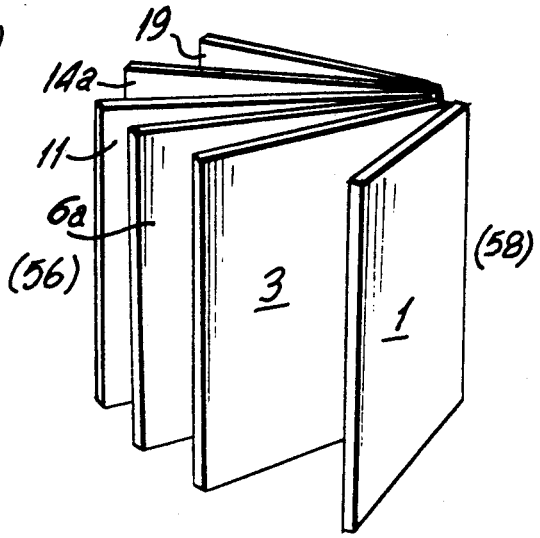
Figure 6:
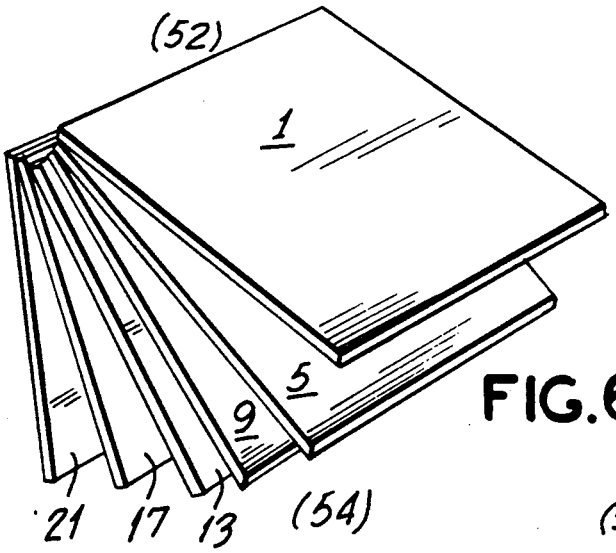
Figure 7:
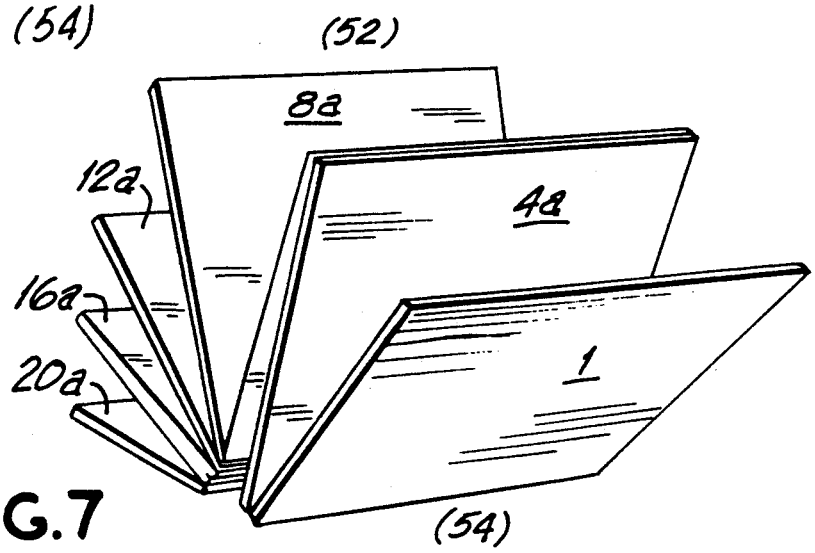

FIGS. 4, 5, 6 and 7 illustrate the twenty-one leaf version of 51 folded according to FIG. 3., with each of FIGS. 4, 5, 6, and 7 opening to reveal a different sequence of pages. Thus, FIG. 4 illustrates 50 in its novel book form opening from right 58 towards left 56. The sequence of pages revealed by this direction of opening is 1*a*, 2*a*, 6,7,9*a*, 10*a*, 14, 15, 17*a*, 18*a*. FIG. 5 illustrates 50 in its novel book form opening from left 56 towards right 58. The sequence of pages revealed by this direction of opening is 2, 3, 5*a*, 6*a*, 10, 11, 13*a*, 14*a*,18, 19. FIG. 6 illustrates 50 in its novel book form opening from bottom 54 towards top 52. The sequence of pages revealed by this direction of opening is 4, 5, 8, 9, 12, 13, 16, 17, 20, 21. FIG. 7 illustrates 50 in its novel book form opening from top 52 towards bottom 54. The sequence of pages revealed by this direction of opening is 3*a*, 4*a*, 7*a*, 8*a*, 11*a*, 12*a*, 15*a*, 16*a*, 19*a*, 20*a*.

The above description of the present invention teaches a structure which forms a novel kind of book. The present invention also has the capacity to function as a foldable building structure which can be formed into a myriad of possible configurations, both free standing three dimensional structures and flat patterns. The following description teaches one example of a free standing three dimensional structure formed from the preferred embodiment of the present invention.

Figure 8:
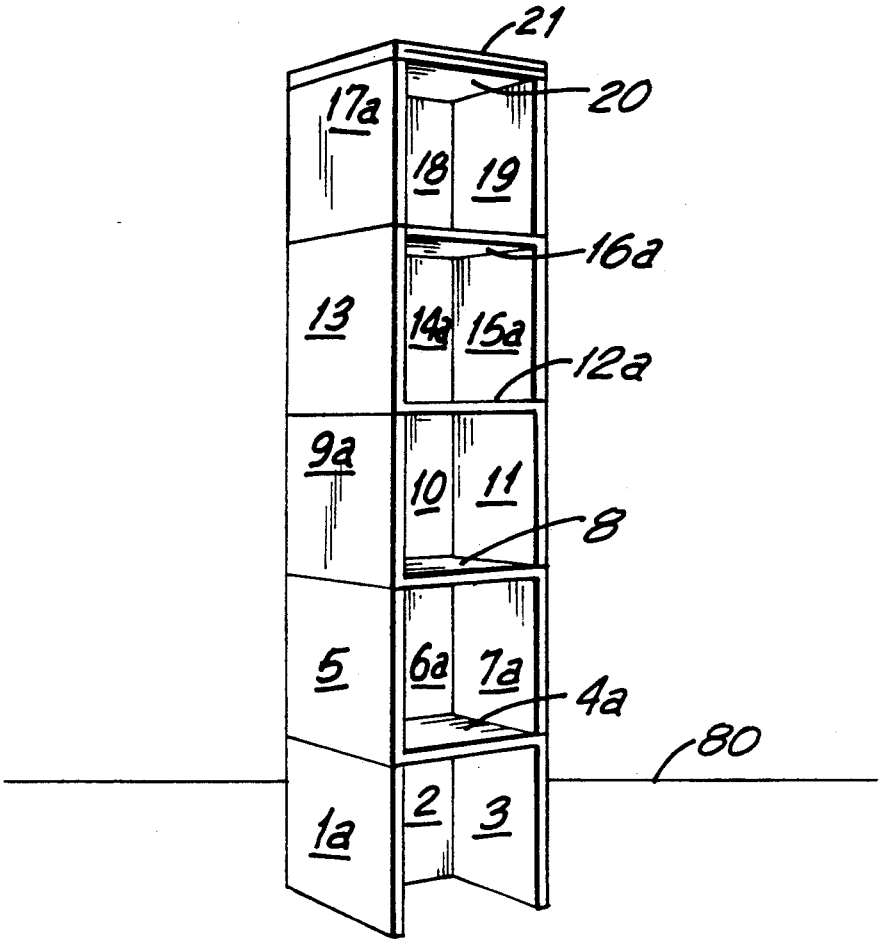
FIG. 8 shows a schematic perspective view of the invention of FIG. 1 in one of its possible building configurations.

Referring to FIG. 1, leaves 1, 2, and 3 are set upright, perpendicular to planar surface 80, folded towards each other such that approximate right angles are formed beween leaves 1 and 2 and leaves 2 and 3, and such that the hinge between leaf 3 and leaf 4 is on the top edge of leaf 3. Leaf 4 folds over such that leaf 4 is parallel to planar surface 80, forming an approximate right angle with leaf 3 and is supported by and forms an approximate right angle with leaf 1. To create the structure illustrated in FIG. 8 the above sequence of building is repeated upward such that leaves 5, 9, 13, and 17 correspond to leaf 1; leaves 6, 10, 14, and 18 correspond to leaf 2; leaves 7, 11, 15 and 19 correspond to leaf 3; leaves 8, 12, 16 and 20 correspond to leaf 4; and leaf 21 folds to lie flat against leaf 20.

Figure 9:
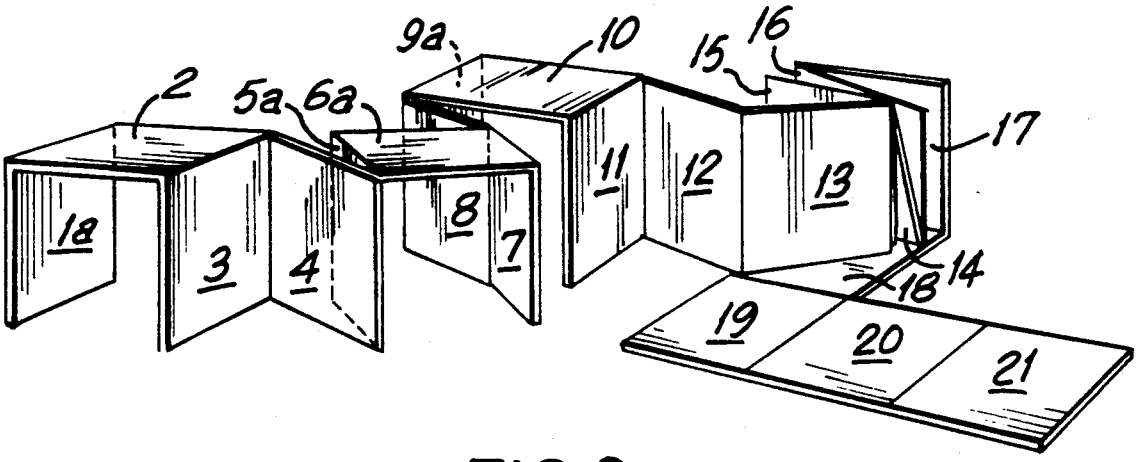
FIG. 9 shows a schematic perspective view of the invention of FIG. 1 and FIG. 8 in another of the possible configurations.

It will be realized by those skilled in the art as well as by those newly introduced to the art that there are countless configurations which can be formed by the present invention. FIG. 9 illustrates a configuration different from FIG. 8, though both are formed with the preferred embodiment of the present invention.

The preferred embodiment of the present invention consists of twenty-one square leaves arranged in the pattern illustrated in FIG. 1. Alternative embodiments include at least five square leaves arranged in said pattern.

While in its simplest form the present invention could be constructed from cardboard sections foldably hinged together with tape, more sophisticated, hinged foldable structures could be made from a variety of material extending from ordinary weight paper to heavy cardboards, rigid and flexible plastic, and/or other materials which will readily suggest themselves.

It will be evident to those skilled in the art that the invention is not limited to the details of the foregoing illustrative embodiments and that the present invention may be embodied in other specific forms without departing from the spirit or essential attributes thereof. It is therefore desired that the present embodiments be considered in all respects as illustrative and not restrictive, reference being made to the appended claims, rather than to the foregoing description, in which it is intended to claim all modifications coming within the scope and spirit of the invention.

What is claimed is:

1. A foldable structure for forming a book like arrangement comprising:

a flat planar element in the form of a square wave about a horizontal axis, said planar element having a plurality of vertical segments and a plurality of horizontal segments, said planar element having a predetermined vertical dimension, each of said vertical segments extending across said vertical dimension, each of said segments having N square panel portions, adjacent panel portions being separated by a fold line, accordion folding of successive panel portions providing a square book like structure.

2. The folding structure of claim 1 wherein each of said panels is rigid.

3. The foldable structure of claim 1 wherein N equals at least 3.

* * * * *